United States Patent [19]

Suttles

[11] Patent Number: 4,850,285

[45] Date of Patent: Jul. 25, 1989

[54] SHELVING SYSTEM

[75] Inventor: James M. Suttles, Elberton, Ga.

[73] Assignee: Royston Manufacturing Corporation, Royston, Ga.

[21] Appl. No.: 571,792

[22] Filed: Jan. 18, 1984

[51] Int. Cl.[4] ..... A47B 9/00

[52] U.S. Cl. ..... 108/108; 24/701; 108/110; 108/144; 211/187; 248/243

[58] Field of Search ..... 108/108, 109, 110, 111, 108/107, 106, 96, 144; 403/254, 255; 211/187, 190, 191, 90; 24/701, 702; 248/243

[56] References Cited

U.S. PATENT DOCUMENTS

| | | | |
|---|---|---|---|
| 567,002 | 9/1896 | Poindexter | 248/243 |
| 782,035 | 2/1905 | Keil | 248/243 |
| 874,014 | 12/1907 | Kurtzon | 248/243 |
| 1,105,738 | 8/1914 | Winter | 24/701 |
| 2,991,889 | 7/1961 | Levy et al. | 211/190 |
| 3,040,905 | 6/1962 | Gingher et al. | 108/108 |
| 3,080,980 | 3/1963 | Gibbons | 248/243 X |
| 3,081,718 | 3/1963 | Shoffner | 108/108 |
| 3,085,693 | 4/1963 | Shell | 211/134 |
| 3,269,077 | 8/1966 | Janus | 248/243 X |
| 3,511,193 | 5/1970 | Schild | 248/243 X |
| 3,604,669 | 9/1971 | Asher | 108/108 X |
| 3,713,257 | 1/1973 | Beavers | 248/243 X |
| 3,919,950 | 11/1975 | Frazelle et al. | 108/108 X |
| 3,965,826 | 6/1976 | Markham | 211/187 X |
| 4,098,480 | 7/1978 | Neumann | 248/243 |
| 4,378,925 | 4/1983 | Griffin | 108/108 X |

FOREIGN PATENT DOCUMENTS

| | | | |
|---|---|---|---|
| 607234 | 10/1960 | Canada | 248/243 |
| 536723 | 10/1931 | Fed. Rep. of Germany | 248/243 |
| 1147971 | 12/1957 | France | 248/243 |
| 1445606 | 6/1966 | France | 211/187 |

*Primary Examiner*—Kenneth J. Dorner

*Assistant Examiner*—Thomas A. Rendos

*Attorney, Agent, or Firm*—Howson & Howson

[57] ABSTRACT

Sheet metal convenience store shelving utilizes shelf-supporting frame-modules, each of which comprises a prefabricated frame rigidly connectable to a pair of shoes to provide free-standing units. Shelves are supportable on both sides of the frames, and the rear edges of the shelves are notched to receive the frame uprights. Each frame holds a removable backing panel, and additional backing panels extend between adjacent frames, being held in side channels of the frame uprights.

The shelves are mounted on the uprights by the engagement of generally horizontally sheet metal shelf tabs with T-shaped slots in the uprights. The tabs extend laterally almost the full interior width of the uprights for optimum strength. As the shelves extend beyond the frame uprights, provision is made to prevent accidental disengagement due to excess weight on an overhanging part of a shelf. The tab neck is enlarged next to the head, and the lower ends of the T-shaped slots are enlarged to receive the enlarged part of the neck underneath overhanging surfaces. The shelf must be tilted upwardly before it can be disengaged from the slots.

Upper and lower tabs associated with a shelf bracket are aligned with each other by first securing a tab to the underside of a shelf, and then locating the bracket with respect to the tab by the interengagement of fingers on the bracket with notches in the edges of the tab attached to the shelf. The second tab is secured to the bracket in a predetermined location established by cooperating locating means.

The frame modules may be arranged either in a line, or at right angles so that shelving extends continuously around a corner. A unitary L-shaped sheet metal backing panel is used as a backing at the corner, and is secured to both frames by sheet metal screws.

2 Claims, 7 Drawing Sheets

SHELVING SYSTEM

BRIEF SUMMARY OF THE INVENTION

This invention relates to shelving systems, and more specifically to improvements in merchandising shelving for use in supermarkets, convenience stores and the like.

While many different types of shelving systems are in use in the field of merchandising, there still exists a need for a shelving system which is inexpensive, versatile, strong yet structurally simple, easy to assemble, take apart and modify, easy to clean, easy to manufacture, and convenient to ship. It is an object of this invention to provide a novel shelving system which satisfies one or more of these needs.

The shelving system in accordance with the invention utilizes frame modules which can be arranged in a store in any of a large number of possible layouts. Sheet metal shelves are mountable on the frame modules in many different configurations. The frame modules and shelves can be arranged to form aisles of any desired length in a store. They can also be arranged to provide for shelving which continues around corners, and can be arranged to form merchandising islands. Thus, the system in accordance with the invention provides a high degree of flexibility for the layout designer.

Each frame module comprises a pre-assembled frame having a pair of slotted uprights held in fixed relationship to each other by a cross member at the top, and another cross member near the bottom. The frame module also includes a pair of shoes for receiving the respective uprights. A plate secured to the bottom of each of the uprights fits into a specially configured receiving structure in its corresponding shoe to provide for an extremely strong and stable, free-standing, shelf-support structure. The only elements touching the floor are the shoes themselves. This makes it easy to maintain the area underneath the shelving clean.

The uprights of each frame are spaced from each other by a distance less than the length of a shelf. Thus, the shelf is supported by shelf brackets at locations spaced inwardly from its ends, and has overhanging portions extending beyond the sides of its frame. In this way, near-optimum shelf strength can be achieved with minimum shelf weight, and with a small, easily transported frame.

A novel shelf tab structure utilizing horizontal, rather than vertical, tabs provides for optimum strength in the shelf-supporting structure while minimizing weight in the frame. The tabs are heavy gauge sheet metal stampings having horizontal heads which extend into slots in the frame uprights. The slots are generally T-shaped slots punched in a web of the upright. Flanges extend rewardly from both sides of the web, and the horizontal upper parts of the T-shaped slots extend almost from one flange to another to accomodate the widest possible tab head. The tab heads engage the rear side of the slotted upright web at locations near the side flanges of the upright so that the load is borne by the side flanges, and bending of the slotted web under the shelf load is avoided. A novel tab-and-slot structure prevents excess weight on an overhanging shelf portion from causing disengagement of the remote shelf tabs on the same shelf from their slots.

The frames are designed so that shelves can be mounted on both sides. A panel may be received in each frame to provide a backing for the portions of its shelves which extend between the uprights of the frame. Slots are provided on the outer sides of the uprights of each frame so that panels can be received and held between adjacent frames to provide backing for the overhanging shelf sections.

If two frames are arranged at right angles to each other, shelving can be arranged to extend continuously around a corner by the appropriate choice of shelf lengths so that the end of a shelf on one of the two frames abuts the front edge of a shelf at the same level on the other of the two frames. A unitary backing member comprising two panels at right angles to each other can be fastened to these two frames to provide a backing in the form of a corner.

Where shelves are arranged on both sides of a frame, or on both sides of a series of frames, the overhanging portions of two shelves at the same level at the end of an aisle can provide a substantially continuous end-of-aisle merchandise area, with a relatively small gap, if any, between the overhanging shelf sections. The rear edges of the shelves are provided with notches to receive the uprights of the frames. Thus, the rear edges of the overhanging shelf sections at the ends of aisle are positioned close together. These notches in the rear edges of the shelves also make it possible for the rear edges of the shelves to come into close proximity to the backing panels supported in the frames, thus preventing articles from falling downwardly through gaps between the rear edges of the shelves and the panels.

Each shelf has a pair of brackets, preferably on its underside, and each bracket has a pair of horizontal tabs for attachment to the uprights of the supporting frames. In the assembly of the shelves, brackets and tabs, it is very important to insure that the tabs are properly positioned with respect to one another. This is accomplished as follows. First, tabs are secured to the underside of a shelf, preferably within the rear edge notches, if such notches are provided. These tabs are positioned in pre-established locations by the engagement of projections on the tabs with pre-punched holes or indentations in the underside of the shelf. The side edges of the tabs are notched, to receive fingers formed in a shelf bracket. The position of the shelf bracket relative to the tab already attached to the shelf is established by engagement of fingers and side edge notches in the tab. A second tab, which may be identical to the first tab, is located on the shelf bracket by the engagement of projections formed on the tab with pre-punched holes or indentations in the shelf bracket. This second tab can be attached to the shelf bracket either before or after the shelf bracket is secured to the shelf. The foregoing scheme accurately positions the two tabs associated with a given bracket relative to each other. If the tabs are identical to each other, the second tab, which will be the lower tab, when the shelf is installed on a frame, will have two side-notches. These side-notches can be engaged in a shelf slot in such a way as to support the shelf in a tilted position, as an alternative to its normal horizontal position.

The horizontal tab heads are connected to the tab body by necks which slide downwardly into the vertical parts of the T-shaped slots in the uprights. The bottoms of the T-shaped slots are enlarged to provide overhanging edges. The part of the neck of each tab nearest the head is provided with an enlargement capable of engaging these overhanging edges of the vertical part of the slot. Thus, when a shelf is mounted on a frame, the weight of the shelf and the articles supported on it causes the enlarged portions of the necks of the shelf's upper tabs to be positioned underneath the overhanging sections of their slots. Excess weight applied to an overhanging portion of the shelf would normally cause the opposite end of the shelf to pivot upwardly, and cause disengagement of the tabs nearest said opposite end from their support. Such disengagement is prevented by the engagement of the enlarged neck portion of the upper tabs with the overhanging edges of the vertical portions of their slots.

Further objects, details and advantages of the present invention will be apparent from the following detailed description when read in conjunction with the drawings.

DETAILED DESCRIPTION

The Frame Modules

Figure 1:
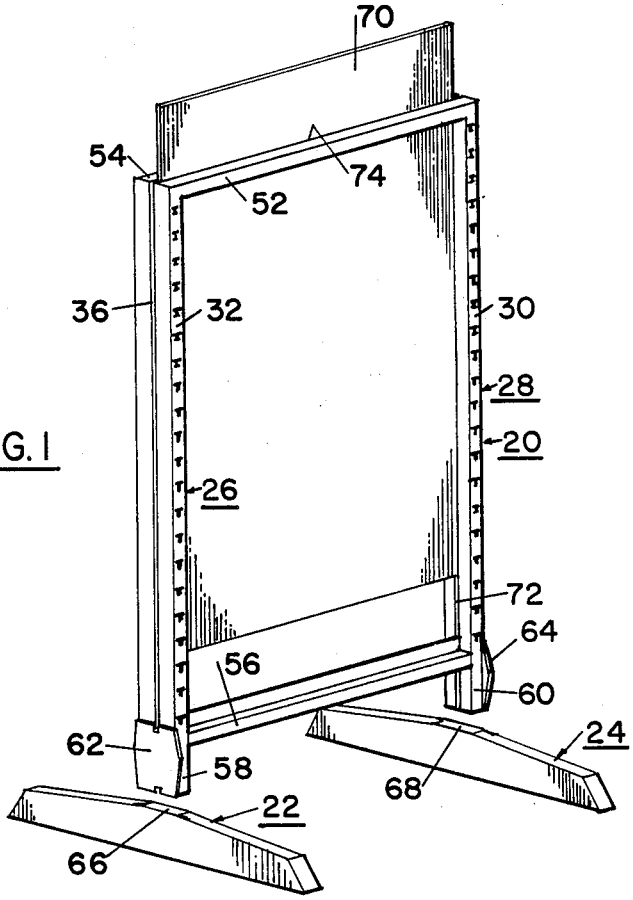
FIG. 1 is an oblique perspective exploded view of a frame module in accordance with the invention, showing the frame disconnected from its shoes, and showing a panel partially installed in the frame.

FIG. 1 shows a frame module comprising a frame 20 and frame-supporting shoes 22 and 24. The frame comprises uprights 26 and 28 which are attachable respectively to shoes 22 and 24. The spacing of the uprights of a frame is typically about two feet from center line to center line, though it is possible to construct frames with other upright spacings.

Upright 28 has a slotted face 30, and upright 26 has a slotted face 32. The opposite faces of the uprights (not seen in FIG. 1) are similarly slotted. The frame is symmetrical in the sense that its front side, which is the side seen in FIG. 1, is identical to its rear side. Each of the shoes extends both forwardly and rearwardly of the frame to the same extent.

Figure 2:
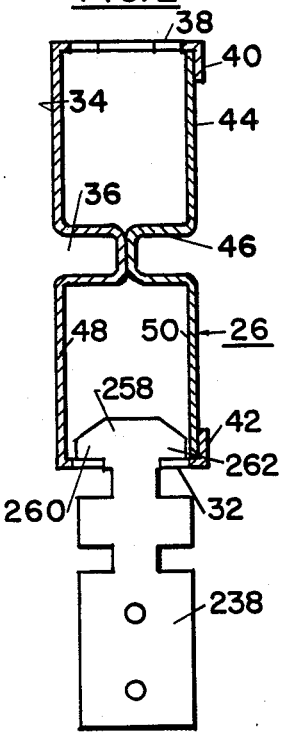
FIG. 2 is a horizontal section through a frame upright showing an upper shelf tab in engagement with it.
Figure 3:
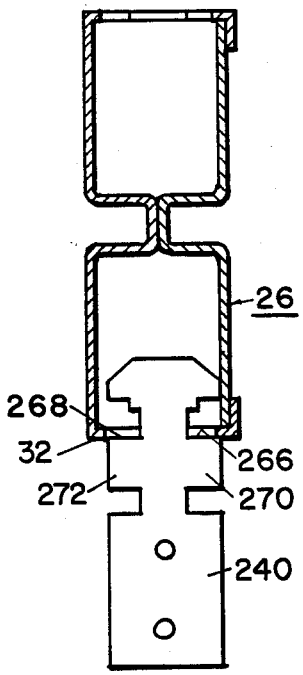
FIG. 3 is a horizontal section through a shelf upright showing a lower shelf tab in engagement with it in a first of two alternative positions.
Figure 4:
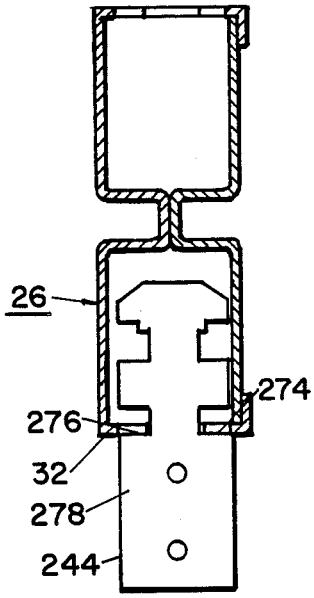
FIG. 4 is a horizontal section through a frame upright showing a lower shelf tab in engagement with it in a second of two alternative positions.

As seen in FIG. 2, upright 26 comprises two formed sheet metal members which are connected together. A first member 34 is formed in such a way as to provide a vertically extending central channel 36. Front face 32 and rear face 38 are perpendicular to, and unitary with, the side element 48 of part 34. Rear face 38 has a forwardly extending flange 40, and front face 32 has a similar rearwardly extending flange 42. A second member 44 of upright 26 extends from the front face to the rear face, and abuts flanges 40 and 42. A channel 46 is formed in member 44. Channel 46 is aligned with channel 36, and both channels are located midway between the front and rear faces. Members 34 and 44 are spot-welded together at vertically spaced intervals where member 44 meets flanges 40 and 42. Faces 32 and 38 are thus firmly secured to side wall 50 of the upright.

Again referring to FIG. 1, uprights 26 and 28 are connected together at their upper ends by parallel front and rear cross-members 52 and 54. These members are spaced from each other by approximately the same width as the width of channel 46 (FIG. 2). The uprights are connected together near their bottom ends by cross-member 56. Upright 26 has an extension 58 extending below cross-member 56, and upright 28 has a similar extension 60. Plate 62 is welded to extension 58, and a similar plate 64 is welded to extension 60. These plates are provided for the purpose of establishing a secure connection of the uprights to their shoes, as will be explained in detail below with reference to FIGS. 6–9. Extension 58 and its plate 62 fit into an opening 66 in shoe 22. Extension 60 and its plate 64 fit into an opening 68 in shoe 24.

A backing panel 70, which may be of wood, composition board, or similar material, slides downwardly through space 74 between upper cross-members 52 and 54, and is held between slot 46 (FIG. 2) of upright 26 and slot 72 (FIG. 1) of upright 20.

Figure 5:
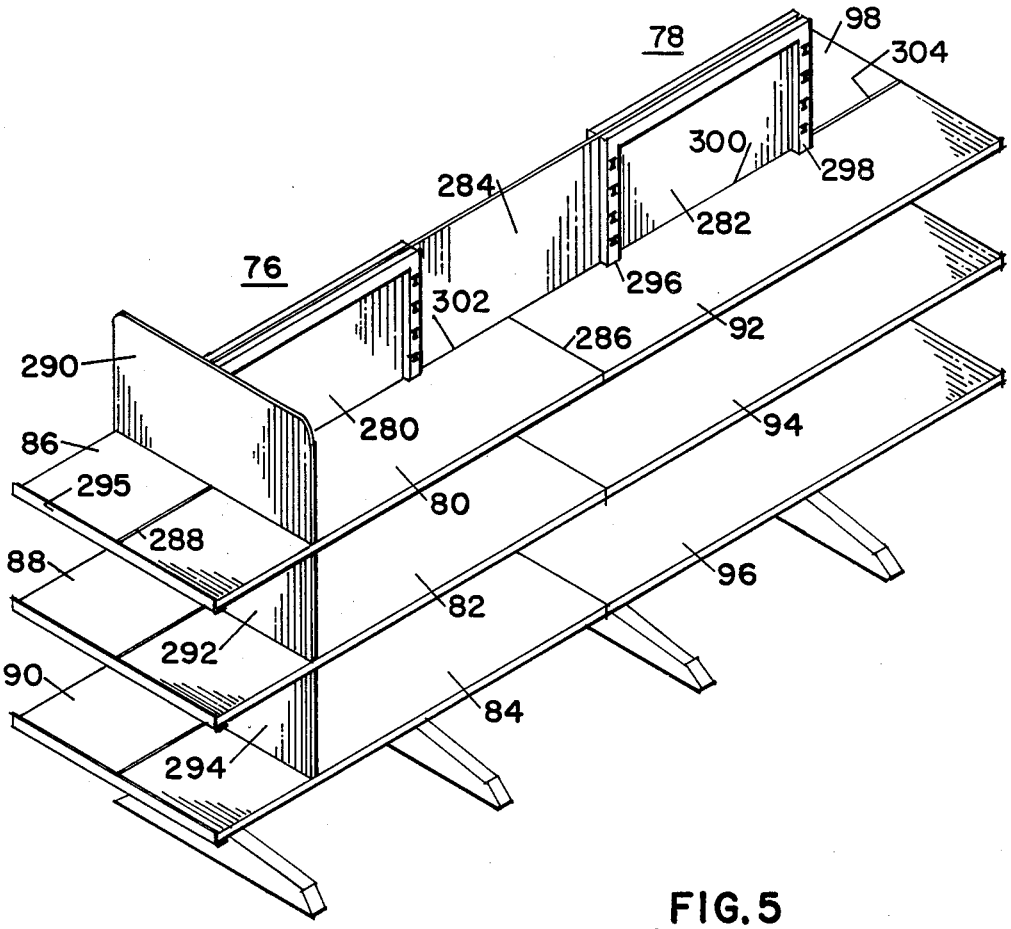
FIG. 5 is an oblique perspective view of a shelving system in accordance with the invention comprising two frames with shelves on both sides.

FIG. 5 shows a system of shelving comprising frames 76 and 78. Shelves 80, 82 and 84 are supported on one side of frame 76, and shelves 86, 88 and 90 are supported on the other side of frame 76. Frame 78 supports shelves 92, 94 and 96 at the same levels respectively as shelves 80, 82 and 84. The ends of the shelves meet to provide elongated continuous shelving. Three shelves are supported on the opposite side of frame 78, but only shelf 98 is visible in FIG. 5.

Figure 6:
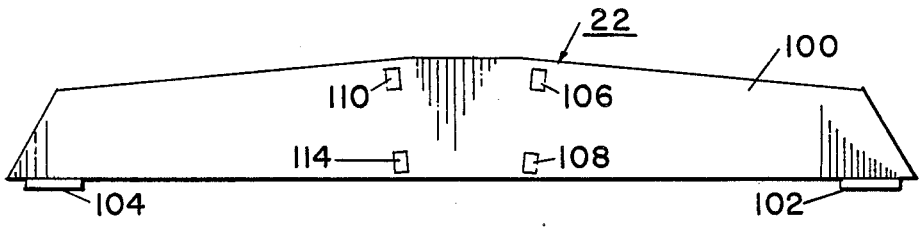
FIG. 6 is a side elevation of a frame-supporting shoe in accordance with the invention.
Figure 8:
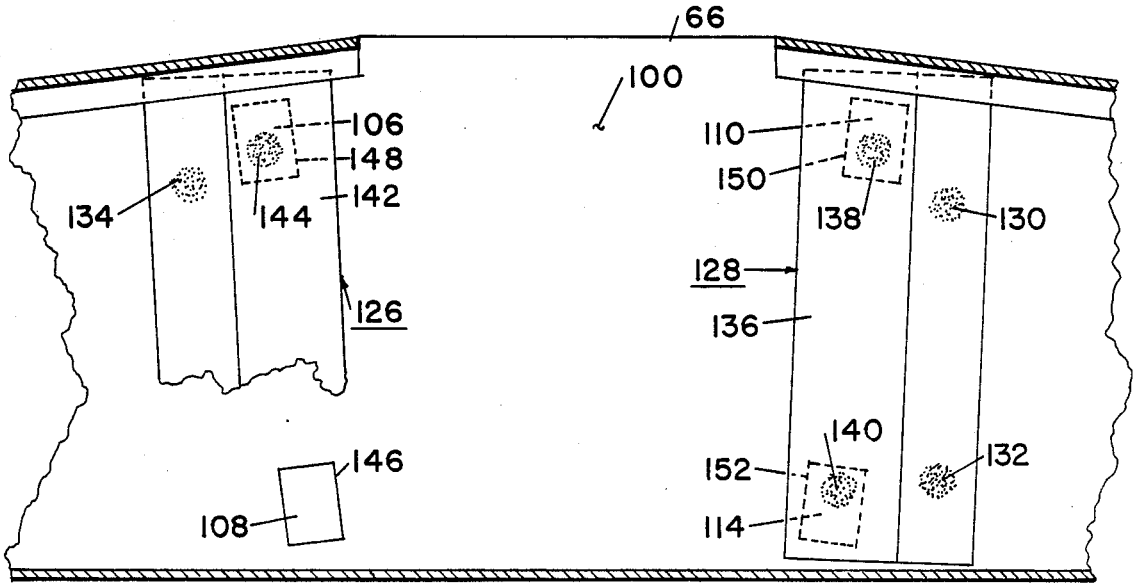
FIG. 8 is a partially broken away fragmentary vertical section taken on the plane 8—8 of FIG. 7, and further illustrating the details of the upright receiving structure of the shoe.
Figure 7:
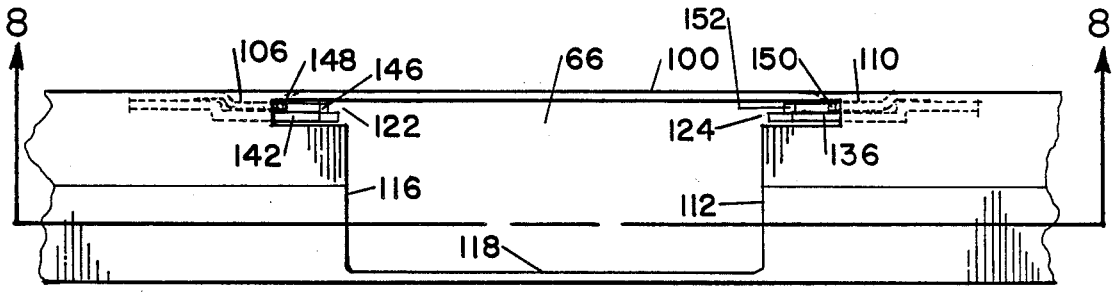
FIG. 7 is a fragmentary top plan view showing the upright-receiving structure of a shoe in accordance with the invention.

As shown in FIGS. 6, 7 and 8, shoe 22 comprises a sheet metal body 100 with front and rear foot pads 102 and 104. The foot pads may be made vertically adjustable. Rectangular tabs 106, 108, 110 and 114 are struck inwardly from a side wall of shoe body 100. These tabs cooperate with plate 62 (FIG. 1) as will appear below.

Referring to FIG. 7, opening 66 of the shoe is generally rectangular in shape, being defined by front and rear edges 116 and 112, by side edge 118, which is the upper edge of one side wall, and by the upper edge of the opposite side wall. Opening 66 has extensions 122 and 124 for receiving plate 62 (FIG. 1). As shown in FIG. 8, reinforcing elements 126 and 128 are spot welded to the side wall of the shoe, spot welds being indicated at 130, 132 and 134. Reinforcing element 128 has a flange 136 which extends in parallel spaced relationship to the side wall, the spacing being substantially equal to the thickness of plate 62 (FIG. 1), the plate fitting between flange 136 and the adjacent side wall. As shown in FIG. 8, flange 136 of reinforcing element 128 is welded to tab 110 at 138, and to tab 114 at 140. A similar flange 142 of reinforcing element 126 is welded to tabs 106 and 108, a weld at tab 106 being indicated at 144.

Edges 146 and 148, of tabs 108 and 106 respectively, are straight oblique edges aligned with each other as shown in FIG. 8. These edges are located in the space between flange 142 and the adjacent side wall of the shoe. Straight, oblique edges 150 and 152 of tabs 110 and 114 respectively, are aligned with each other and located within the space between flange 136 and the adjacent side wall. The welding of the flanges of the reinforcing elements to the inwardly struck tabs provides a very rigid plate-retaining structure, the function of which will be apparent from FIG. 9.

Figure 9:
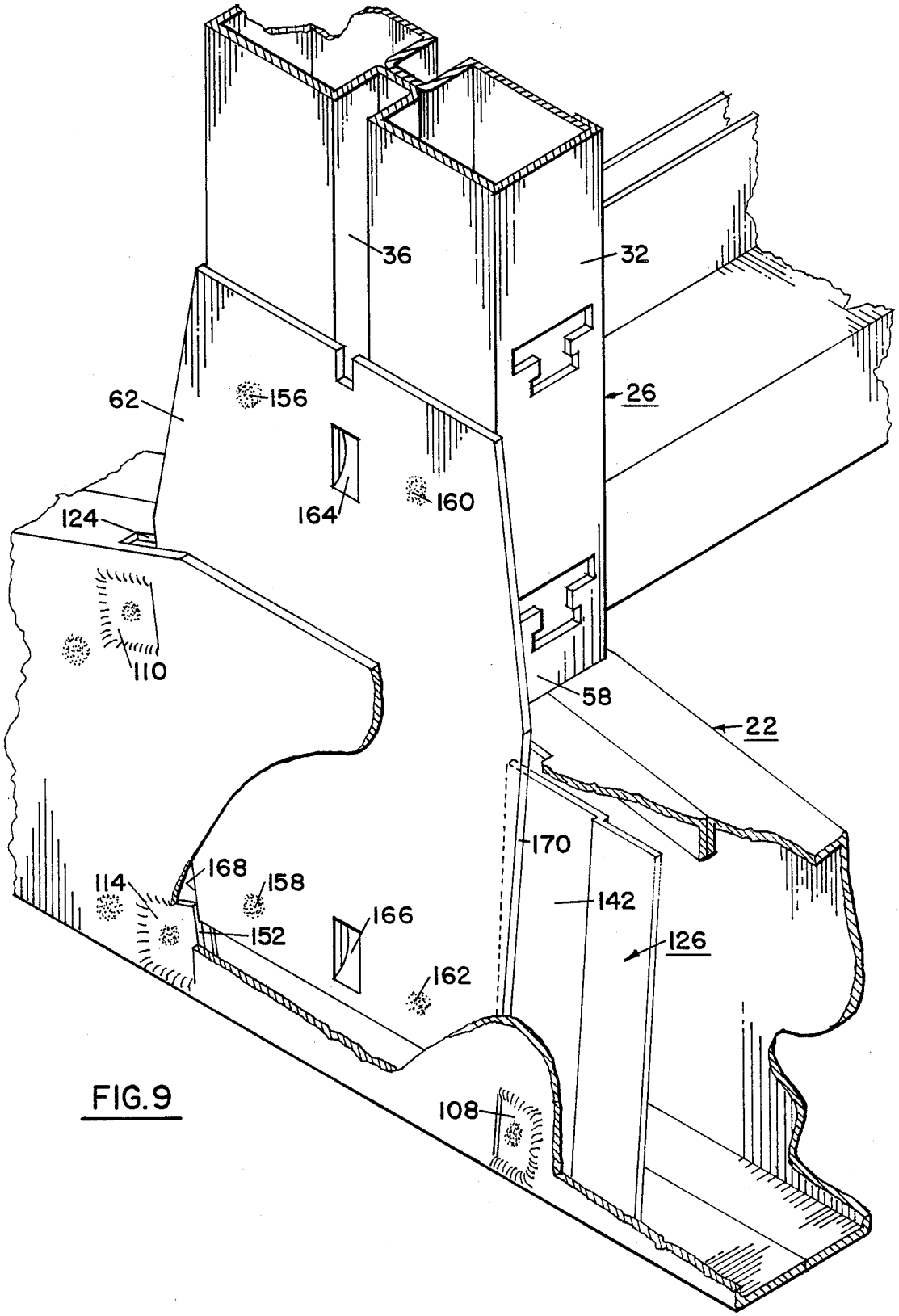
FIG. 9 is a partially broken away fragmentary perspective illustrating the details of the interconnection between a shoe and a frame upright.

In FIG. 9, extension 58 of upright 26, and its plate 62 are shown in engagement with shoe 22. Plate 62 is spot welded to upright 26 at 156, 158, 160 and 162. Struck-out projections 164 and 166 fit into vertical slot 36 in the upright, and align the plate with the upright prior to welding. The lower part of plate 62 has side edges 168 and 170, which converge toward each other in the downward direction. These oblique edges are straight, and conform with the operative edges of the inwardly struck tabs 106, 108, 110 and 114 of the shoe (FIG. 8). That is, the angle between edge 170 and vertical is the same as the angle between tab edges 146 and 148 and the vertical. Likewise, the angle between plate edge 168 and the vertical is the same as the angle between the vertical and tab edges 150 and 152.

As upright extension 58 is moved downwardly into the opening in the shoe, plate 62 is accommodated by the extensions of the rectangular opening in the shoe, and moves downwardly into the space between the shoe side wall and the flanges of the reinforcing elements. Downward movement of the plate continues until its side edges 168 and 170 contact the operative edges of the tabs. Contact between plate 168 and operative edge 152 of tab 114 is seen in FIG. 9. The weight of the uprights (and the other elements of the frame, and the shelving and displayed articles on the shelving) produce a wedging action between the tabs and the plate edges. The plate also fits tightly between the flanges of the reinforcing element and the side wall of the shoe. The wedging action and the tight fit of the plate edges between the shoe side wall and the reinforcing elements positively locks the frame and shoe together, providing an extremely strong and stable structure capable of withstanding large horizontal forces exerted in any direction on the upper parts of the frame. Continuous forces or sharp blows on the frame do not result in excessive vibration, or wobbling movement of the frame, or in loosening of the connection between the frame and its shoes. This structure has the advantage that it allows the shoes to be independent elements, with no connection to each other except through the frame itself. The shoes can be small in size, and can be easily shipped. There is no need for the attachment of additional reinforcing elements such as "kick-plates" to the shoes in on-site assembly. Therefore, the structure not only eliminates the need for additional parts, but it also reduces assembly time, and provides open space at the base of the shelving assembly, allowing easy cleaning of the floor without disassembly of the shelving. The structure of FIG. 9 also has the advantage that it is entirely free of fasteners, and can be assembled very rapidly.

The Shelf Structure

Figure 10:
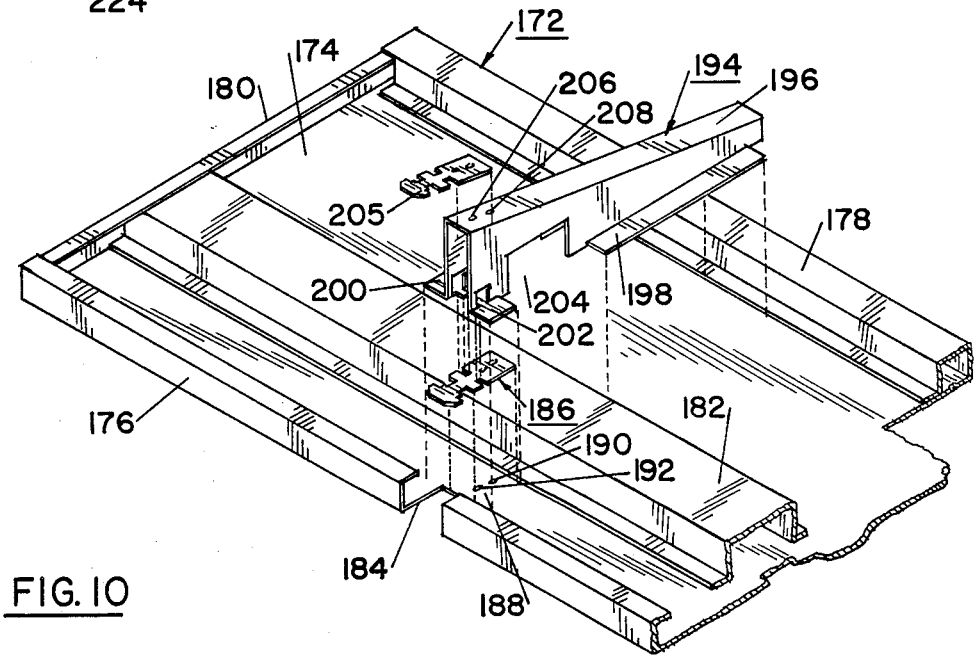
FIG. 10 is an exploded perspective showing the manner in which tabs and a bracket are secured to the underside of a shelf.

FIG. 10 shows the underside of a typical shelf 172. This shelf may be constructed entirely of sheet metal. The underside of its article-supporting surface is seen at 174. An L-shaped flange 176 is formed along the rear edge of the shelf, and the front edge of the shelf is formed to provide a box-like reinforcement 178. Reinforcements are formed along the side edges of the shelf as well, one such reinforcement being indicated at 180. A reinforcing channel 182 extends from one side edge to the other, at an intermediate location between the front and rear edges of the shelf, but closer to the rear edge than to the front edge.

The rear edge of the shelf is notched at 184, the notch being of a width slightly greater than that of one of the frame uprights, and having a depth, measured in the plane of article-supporting surface 174, approximately equal to the distance between a face of an upright and its panel-retaining channels, i.e. just under one-half the distance between the front and back faces 32 and 38 of the upright (see FIG. 2). Notch 184 is spaced from side edge reinforcement 180.

A first upright-engaging tab 186 is secured at location 188 on the underside of the article-supporting surface 174 of the shelf. Projections formed on tab 186 engage locating holes 190 and 192 in surface 174, and tab 186 is secured in place by welding. It extends rearwardly into notch 184.

A shelf bracket 194 comprises a channel-like member 196 which is attached to the underside of the shelf, and which is vertically tapered in such a way that its end near the rear of the shelf is higher than its end near the front of the shelf. Bracket 194 has flanges which engage surface 174 to provide an area for spot welding. Three such flanges are indicated at 198, 200 and 202. The bracket is cut out at 204 to allow clearance for reinforcing channel 182.

A second tab 205, which may be identical to tab 186, is secured to bracket 194 by welding, projections on the tab being engaged with locating holes 206 and 208 on the bracket.

Figure 11:
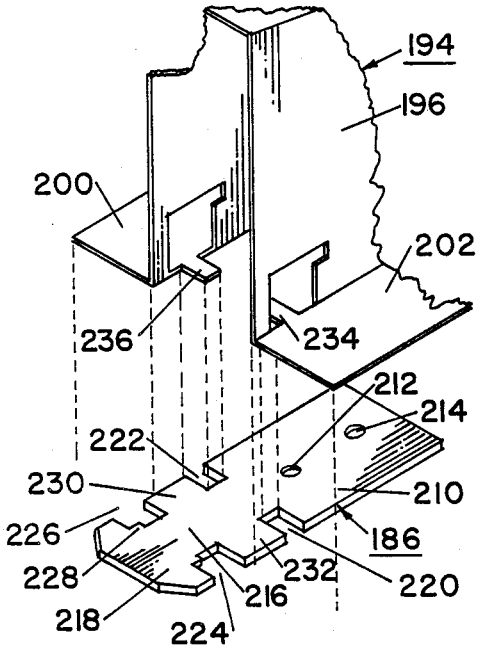
FIG. 11 is an enlarged exploded perspective showing details of the interconnection between the bracket and the shelf tab attached to the shelf.

As shown in FIG. 11, tab 186 comprises a rectangular section 210. Section 210 is punched at 212 and 214 to provide projections for engaging locating holes in the shelf. These projections are on the underside of tab section 210, as viewed in FIG. 11.

A neck 216 extends rearwardly from rectangular section 210, and terminates in a head 218, which extends laterally in both directions from the neck. Notches are provided at 220 and 222, and at 224 and 226. The portion of neck 216 between notches 224 and 226 is widened at 228 next to the head to provide part of an anti-disengagement feature which will be described with reference to FIGS. 2 and 12. Notches 220 and 224 are separated by wing 232, and notches 222 and 226 are separated by wing 230.

Notches 220 and 222 serve as locating notches for the bracket, and receive respectively tabs 234 and 236, which extend inwardly from bracket flanges 202 and 200.

It is important to locate tabs 186 and 205 (FIG. 10) accurately with respect to the shelf and with respect to each other. Even slight deviation from accurate alignment may make it difficult or impossible to install the shelves satisfactorily on the frames. Accurate alignment is accomplished by providing locating projections, tabs and holes at their proper locations in the process of fabricating parts, and by following a simple assembly procedure.

Referring to FIG. 10, tab 186 is secured to shelf surface 184 by welding after engagement of its two locating projections with locating holes 190 and 192. Thereafter, bracket 194 is secured to underside 174 of the shelf by spot welding, after positioning the bracket in predetermined relationship to tab 186 by interengagement of tabs 234 and 236 on the bracket (FIG. 11) with notches 220 and 222 on the tab. Tab 205 may then be secured to the bracket after engagement of its locating projections with bracket holes 206 and 208. This procedure insures proper alignment of the tabs with each other and proper positioning of the tabs and bracket with respect to the shelf. Tab 205 may, of course, be secured to bracket 194 either before or after bracket 194 is secured to the shelf.

Shelf 172 of FIG. 10, of course, has an additional notch and bracket with upright-engaging tabs not shown in FIG. 10.

Tab and Slot Engangement and the Anti-disengagement Feature

Figure 12:
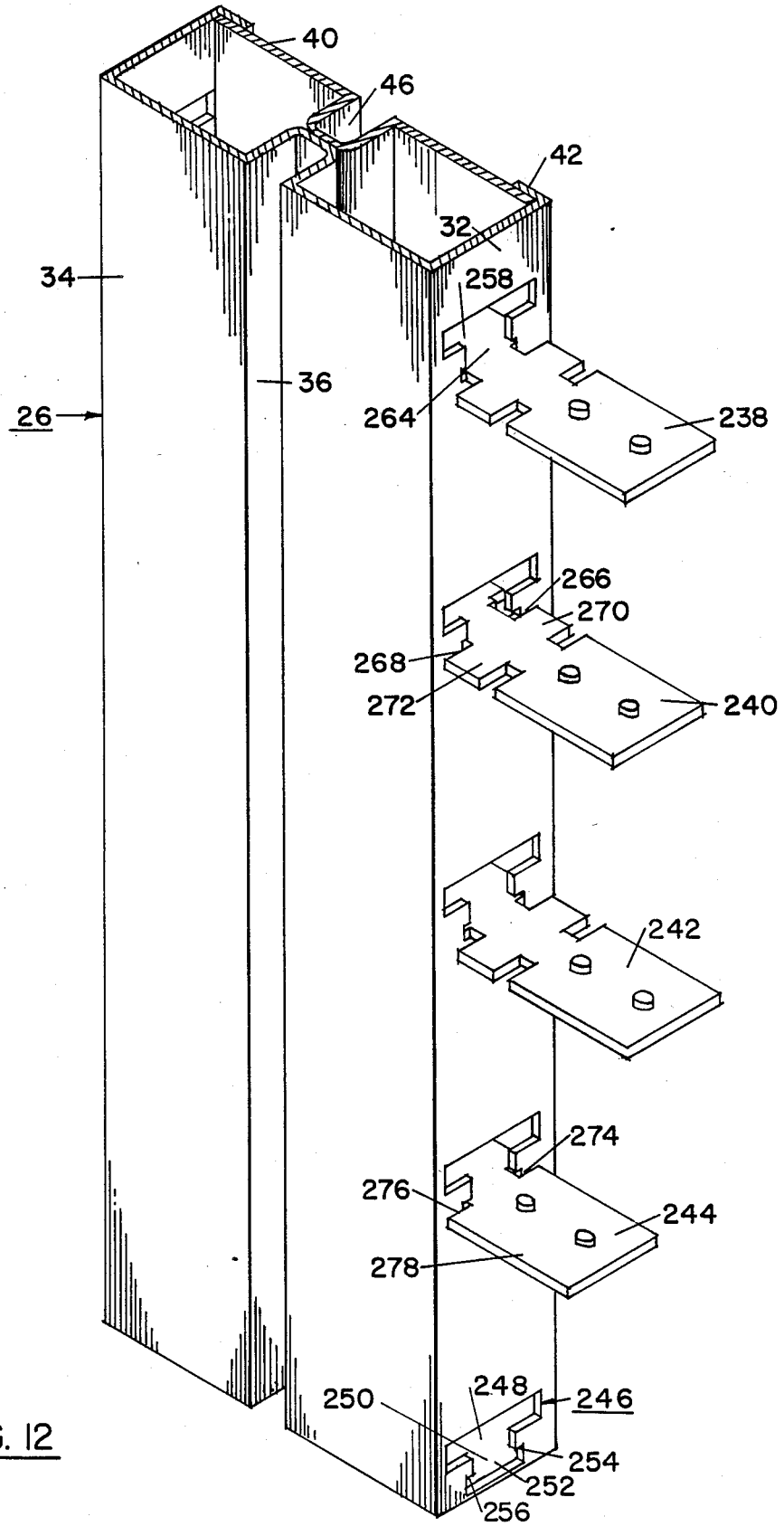
FIG. 12 is a fragmentary perspective view of an upright, showing how two pairs of shelf tabs are engaged with slots in the upright in positions corresponding to two alternatively shelf positions.

Upright 26 in FIG. 12 has two pairs of shelf tabs held in its slots. A first pair, 238 and 240 is associated with the first shelf (not shown), and is supported in a pair of slots in such a way as to hold the article-supporting surface of the shelf horizontal. A second pair of shelf tabs, 242 and 244, is held in slots in the upright in such a way as to support the corresponding shelf with its article-supporting surface sloping downwardly and forwardly. FIG. 12 also shows the details of a typical slot 246. The slot comprises a horizontal opening 248 extending almost the full width of upright face 32, and a vertical opening 250 extending downwardly from horizontal opening 248, and centered thereon. The lower end for the vertical part of the opening is horizontally enlarged at 252 to provide horizontal overhanging edges 254 and 256. These overhanging edges are also part of the anti-disengagement feature of the invention.

Tab 238 is held in the uppermost slot in FIG. 12 with its head 258 in engagement with the inside of the front wall of the upright on both sides of the vertical part of the slot. The upper, horizontal part of the slot is wide enough to receive the head of the tab, and the tab is installed by moving its head inwardly through the horizontal part of the slot, and then moving the tab downwardly into the vertical part of the slot so that it is held and cannot be removed until it is lifted again. The engagement of the head 258 of tab 238 with the upright is also seen in FIG. 2, where laterally extending parts 260 and 262 of head 258 are shown in engagement with the inside of the front wall of the upright. Preferably, part 260 extends almost to side wall 48, and part 262 extends almost to side wall 50. As mentioned previously, side wall 50 is welded to flange 42. At least part of the contact area between the tab and the front wall of the upright, therefore, is located near the side walls, where the upright is strongest and has the greatest resistance to forwardly directed forces. The spacing between the ends of the head and the sides of the upright should not be more then about twice the thickness of the slotted web. The horizontal tab configuration, with the laterally extending parts 260 and 262 of its head 258, permits the use of a structurally simple upright which is wide enough to have stiffness against sidewise bending, without sacrificing strength in the connection between the tab and the upright. The horizontal tab configuration also permits the use of a structurally simple upright which is wide enough that panel-receiving channels 36 and 46 (FIG. 2) can be formed in its side walls.

Returning to FIG. 12, the enlarged portion 264 of the neck of the tab, which is adjacent to the head, underlies the overhanging surfaces of the vertical part of the slot (corresponding to overhanging surfaces 254 and 256 in slot 246) so that tab 238 cannot move upwardly until it is moved inwardly. Thus, to remove the shelf associated with tabs 238 and 240, the shelf must first be tilted upwardly until part 264 of the tab clears the overhanging parts of the slot. Then, the shelf is moved upwardly until the heads of the tabs can be moved out of the slots through the horizontally extending parts of the slots at their upper ends. Thus, the enlarged parts of the tabs adjacent to their heads and the overhanging parts of the slots cooperate to provide an anti-disengagement feature. The significance of this feature is that it allows the shelves to extend beyond the uprights of the frames, as shown in FIG. 5, without giving rise to the danger that excessive weight on an overhanging part of a shelf will cause the shelf to pivot about one upright and disengage the other upright. This feature makes it possible to make safe use of relatively small and easily shipped prefabricated frames. Such small frames, being prefabricated, can be made significantly stronger than frames assembled on site without requiring additional weight. Because the frame is small in size, it is unnecessary to depend on gussets, trusses or other reinforcements for frame rigidity. The backing panel, furthermore, need not be a structural part of the frame, and therefore can be relatively light in weight.

The lower shelf tab 240 of pair 238 and 240 has the rearwardly facing edges 266 and 268 of its wings 270 and 272 in engagement with face 32 or upright 26. Here again, at least part of the contact area is near the sidewalls, which are better able to resist rearwardly directed forces than is the central part of the face of the upright.

Edges 274 and 276 of rectangular part 278 of tab 244 are in engagement with the front face 32 of the upright, and the wings of the tab are inside the upright. Tab 242 is tilted downwardly slightly, but is in essentially the same position with respect to the upright as in tab 238. The shelf associated with tabs 242 and 244 is tilted so that its article- supporting surface slopes downwardly and forwardly, but its anti-disengagement feature is still operative.

Shelving Assemblies, Aisles and Corner Structures

Referring again to FIG. 5, the structure shown serves as a two-sided merchandising display and aisle divider. Backing panels 280 and 282 are provided in frames 76 and 78 respectively, and a backing panel 284 is held in external slots in the adjacent uprights of the frames. Because of the strength of the frames and the fact that the shelves extend beyond the uprights of the frames, it is unnecessary to provide any reinforcing structure connecting the frames together. Furthermore, the back panels, being non-essential to the rigidity of the frame structure, can be very light in weight. Thus, the structure as shown in FIG. 5 is, as a whole, significantly lighter in weight than a conventional two-sided multiple-gondola, aisle divider and merchandiser assembly. The structure of FIG. 5 may of course be extended to any length by providing suitable numbers of frames, shelves and backing panels. Shelves 80 and 92 are at the same level, and meet at line 286 to provide a continuous article-supporting surface. Shelves 82 and 94 come together similarly, as do shelves 84 and 96, and the corresponding pairs of shelves on the opposite side of the structure.

Shelves 80 and 86, the uppermost shelves on frame 76, extend in both directions beyond frame 76. At the left, they form an end-of-aisle merchandise area, which is essentially continuous, there being only a comparatively narrow gap 288 between them, corresponding to the width of a backing panel. The ends of the shelves can be provided with an optional trim strip 295, which is secured by sheet metal screws to the L-shaped shelf edge reinforcements corresponding to reinforcement 180 in FIG. 10.

Optional dividers 290, 292 and 294 can be secured by sheet metal screws (not shown) to the left upright of frame 76. These dividers separate the end-of-aisle shelving areas from the aisle shelving areas.

Notches 296 and 298, along the rear edge of shelf 92, embrace the uprights of frame 78. These notches allow central section 300 of the rear edge of the shelf to abut or nearly abut backing panel 282. Similarly, section 302 of the rear edge of shelf 92 abuts or nearly abuts backing panel 284. Section 304 of the rear edge of the shelf is spaced slightly from shelf 98, but the gap is equivalent to the width of a backing panel, and in most cases is not significant. In those cases where the gap is significant, a suitable filler can be provided.

Figure 13:
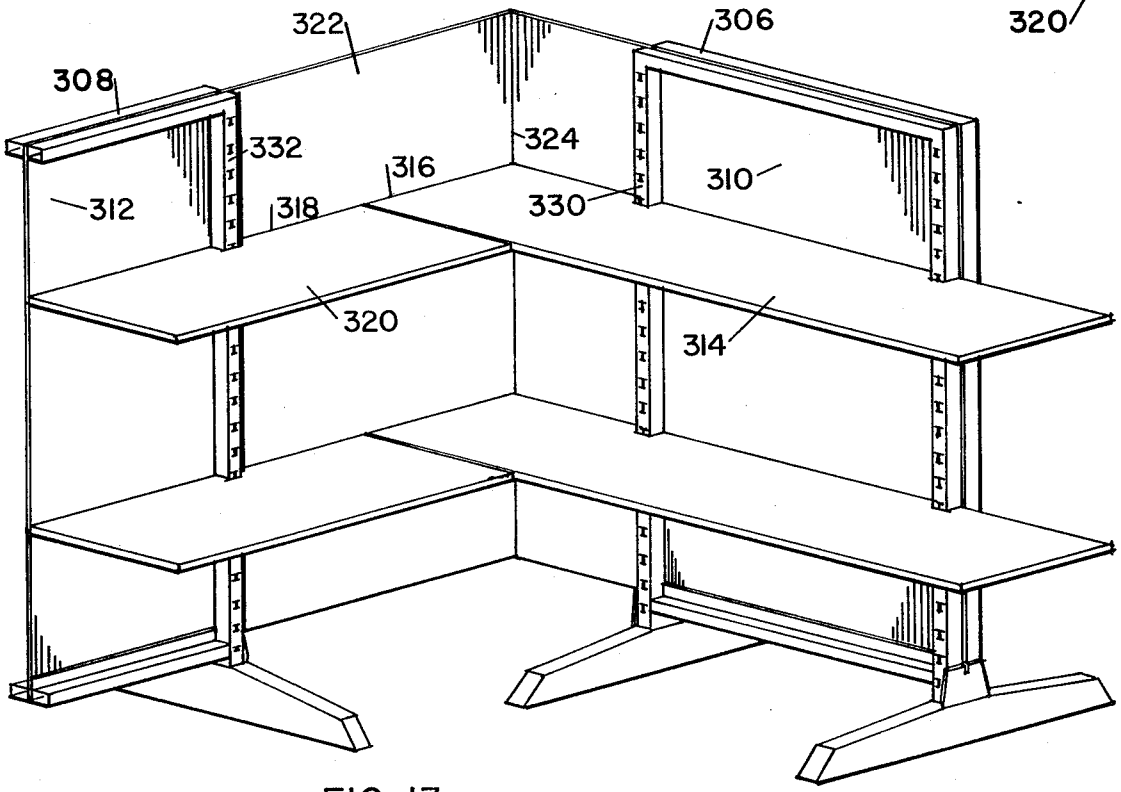
FIG. 13 is a fragmentary perspective view illustrating an arrangement of shelving to form a corner.

Although frames are normally arranged in a straight line, as shown in FIG. 5, frames can also be arranged perpendicular to each other to provide a corner structure as shown in FIG. 13. In FIG. 13, the uprights of frame 306 are aligned with each other in a first horizontal direction, and the uprights of frame 308 are aligned with each other in a second horizontal direction perpendicular to the first horizontal direction. Frame 306 has a backing panel 310, and frame 308 has a backing panel 312.

A shelf 314 is supported on the side of frame 306 on which frame 308 is situated. Similarly, a shelf 320 is supported on frame 308 on the side on which frame 306 is situated. Edge 316 of shelf 314 is aligned with the rear edge 318 of shelf 320. The right-hand edge of shelf 320 abuts the front edge of shelf 314. In this way, shelves 314 and 320 provide a substantially continuous article-supporting surface extending around a corner.

Figure 14:
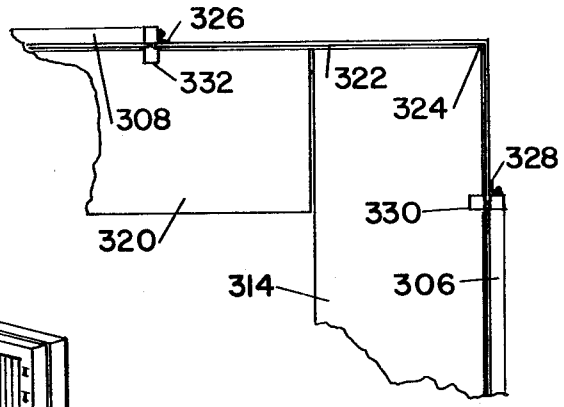
FIG. 14 is a fragmentary top plan view of the structure of FIG. 13, illustrating the manner in which the corner panel is secured to the uprights of the shelf-supporting frames.

A sheet metal backing panel 322, having an L-shaped horizontal cross-section as shown in FIG. 14 is secured by sheet metal screws, and brackets 328 and 326, to uprights 330 and 332 of the respective frames. Its corner 324 is adjacent to the left rear corner of shelf 314.

While the arrangements of FIGS. 13 and 14 lack shelves on the outside of the corner, continuous shelves can also be provided on the outside by using shelves of appropriate lengths so that the shelf on one frame extends all the way to the front edge of the shelf at the same level on the other frame.

Arrangements such as that shown in FIG. 13 can be combined with arrangements such as shown in FIG. 5 in various ways to produce practically and desired shelving configuration, thereby accommodating almost any convenience store floor plan.

Summary of Advantages and Modification

As will be apparent from the foregoing, the various features of the invention, individually, and in combination, provide a highly advantageous shelving system suitable for convenience store use as well as for many other purposes. These advantages include low cost, versatility, high strength, structural simplicity, ease of assembly, ease of modification, ease of cleaning, ease of manufacture, and convenience in shipping. These and other advantages, either described or implied in the foregoing description, arise out of the concept of using a relatively small shelf-supporting frame, the concept of mounting the frame rigidly on independent shoes, the use of horizontal tabs, the heads of which extend outwardly to near the side flanges of the frame uprights, the configuration of tabs and slots which prevents inadvertent disengagement, the scheme for aligning shelf tabs with each other during shelf manufacture, as well as from various other and subsidiary features described herein.

Numerous modifications can be made to the invention as herein described. For example, the shelves can be of any desired length from the frame width upward. The shelves need not be entirely of sheet metal. For example, many of the advantages of the invention can be realized using wire shelves. Many of the advantages of the invention can also be realized in installations in which shelves are supported on wall-mounted uprights, rather than on free-standing frames.

In installations where, for one reason or another, frame modules can not be positioned relative to each other so that their shelves meet to provide continuous article-supporting surfaces, connections between shelves on one frame and shelves on another can be achieved by using sheet-metal filler panels, which attach to the side edges of the respective shelves.

The shelving system of the invention may of course be modified in may other respects without departing from the scope of the invention as defined in the following claims.

I claim:

1. In a shelving system comprising posts each having a vertically extending row of slots and shelves removably attachable to said posts by engagement of shelf tabs with post slots, a shelf having a surface, a first substantially planar sheet metal shelf tab connected directly to said surface of the shelf and situated in a plane substantially parallel to said surface, a bracket also connected directly to said surface of the shelf, interengaging means on the first shelf tab and on the bracket locating the bracket on said surface at a predetermined location relative to the first shelf tab, a second substantially planar shelf tab, and means securing said second tab to the bracket at a location such that when the bracket is connected to said surface of the shelf at said predetermined location, the second tab is spaced by the bracket from the first tab and the first and second tabs are aligned with each other for engagement respectively with first and second slots in a vertically extending row of slots in one of said posts.

2. A shelving system according to claim 1 in which each slot has a horizontally extending opening for entry of a tab and a vertically extending opening extending downwardly from the horizontal opening; in which the first and second shelf tabs are identical and have side edges; in which the interengaging means on the first shelf tab comprises a pair of notches in the side edges thereof; in which the interengaging means on the bracket comprises a pair of tabs mating with said notches; and in which the corresponding notches in the side edges of the second tab extend beyond the bracket and receive the edges of the vertically extending part of one of the slots on the posts.

* * * * *